US011532273B2

(12) United States Patent
Yang et al.

(10) Patent No.: US 11,532,273 B2
(45) Date of Patent: Dec. 20, 2022

(54) METHOD AND DEVICE OF OBTAINING ELECTRICAL DATA OF PIXEL UNIT, AND ARRAY SUBSTRATE

(71) Applicant: BOE Technology Group Co., Ltd., Beijing (CN)

(72) Inventors: Hualing Yang, Beijing (CN); Xinshe Yin, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/352,272

(22) Filed: Jun. 19, 2021

(65) Prior Publication Data

US 2022/0068198 A1 Mar. 3, 2022

(30) Foreign Application Priority Data

Sep. 2, 2020 (CN) ..... 202010911831.X

(51) Int. Cl.
*G09G 3/325* (2016.01)

(52) U.S. Cl.
CPC ..... *G09G 3/325* (2013.01); *G09G 2300/0804* (2013.01); *G09G 2300/0819* (2013.01);
(Continued)

(58) Field of Classification Search
CPC ..... G09G 3/325; G09G 2300/0804; G09G 2300/0819; G09G 2310/0297;
(Continued)

(56) References Cited

U.S. PATENT DOCUMENTS 6,137,340 A * 10/2000 Goodell ..... H03K 17/6257 327/403
2005/0179676 A1 8/2005 Szepesi et al.
(Continued)

FOREIGN PATENT DOCUMENTS

CN 105225631 A 1/2016
CN 105339998 A 2/2016
(Continued)

OTHER PUBLICATIONS

CN202010911831. X First Office Action.
(Continued)

*Primary Examiner* — Md Saiful A Siddiqui
(74) *Attorney, Agent, or Firm* — IPRO, PLLC

(57) ABSTRACT

An array substrate comprising a plurality of pixel units and an external compensation circuit; wherein, for each pixel unit of the plurality of pixel units, the pixel unit comprises a detection switch device, and the pixel unit is connected to a corresponding input end of a multiplexer of the external compensation circuit through the detection switch device; the external compensation circuit is configured: to acquire first data in a case that the detection switch device is opened, the first data comprising noise data caused by a level jump of the multiplexer of the external compensation circuit; to acquire second data in a case that the detection switch device is closed, the second data comprising the noise data and electrical data of the pixel unit; and to obtain the electrical data according to the first data and the second data.

8 Claims, 4 Drawing Sheets

(52) U.S. Cl.
CPC ..... *G09G 2310/0297* (2013.01); *G09G 2310/061* (2013.01)

(58) Field of Classification Search
CPC ..... G09G 2310/061; G09G 2310/0291; G09G 2310/0294; G09G 2320/0295; G09G 3/3233; G09G 3/3225; G09G 3/006
See application file for complete search history.

(56) References Cited

U.S. PATENT DOCUMENTS

| | | | | |
|---|---|---|---|---|
| 2014/0152642 | A1 | 6/2014 | Kim et al. | |
| 2014/0198092 | A1 | 7/2014 | Azizi et al. | |
| 2015/0009204 | A1* | 1/2015 | Chaji ..... | G09G 3/3233 345/76 |
| 2015/0379909 | A1 | 12/2015 | Yu et al. | |
| 2015/0379939 | A1 | 12/2015 | Takasugi et al. | |
| 2016/0104422 | A1 | 4/2016 | Kishi et al. | |
| 2016/0148578 | A1* | 5/2016 | Kishi ..... | G09G 3/3291 345/212 |
| 2017/0154573 | A1* | 6/2017 | Woo ..... | G09G 3/3233 |
| 2017/0256198 | A1* | 9/2017 | Hwang ..... | G09G 3/3266 |
| 2018/0137819 | A1 | 5/2018 | An et al. | |
| 2018/0166515 | A1 | 6/2018 | An et al. | |

FOREIGN PATENT DOCUMENTS

| | | | |
|---|---|---|---|
| CN | 108074524 | A | 5/2018 |
| CN | 111095915 | A | 5/2020 |
| EP | 2738757 | A1 | 6/2014 |
| KR | 20180067152 | A | 6/2018 |

OTHER PUBLICATIONS

CN202010911831.X Second Office Action.
Architectures for Low-noise CMOS Elecrronic Imaging (Common sense excerpts to chapter 9 of Single-Photon Imaging, pp. 181-187).

* cited by examiner

METHOD AND DEVICE OF OBTAINING ELECTRICAL DATA OF PIXEL UNIT, AND ARRAY SUBSTRATE

CROSS REFERENCES TO RELATED APPLICATIONS

This disclosure claims the priority of a Chinese patent application filed with the National Intellectual Property Administration, P. R. C., under CN 202010911831.X, entitled "Method And Device Of Obtaining Electrical Data Of Pixel Unit, And Array Substrate" on Sep. 2, 2020, the entire contents of which are incorporated by reference in this disclosure.

TECHNICAL FIELD

Embodiments of the present disclosure relate to a method and a device of obtaining electrical data of a pixel unit, and an array substrate.

BACKGROUND

At present, for AMOLED display devices, in the art of external compensation known to the inventors, an external compensation circuit collects noise data of each pixel unit separately in a time-division multiplexing manner. After a multiplexer of the external compensation circuit selects an acquiring channel through a switch, there will be a voltage floating in the initial stage of the establishment of the GOA level VGH/VGL of the pixel unit, and the voltage floating is coupled to a sensing line by a parasitic capacitor, resulting in a large error in noise data extracted by the analog-to-digital converter (ADC) in the external compensation circuit.

SUMMARY

At least some embodiments of the present disclosure provide an array substrate including a plurality of pixel units and an external compensation circuit; wherein for each pixel unit of the plurality of pixel units, the pixel unit includes a detection switch device, and the pixel unit is connected to a corresponding input end of a multiplexer of the external compensation circuit through the detection switch device;

the external compensation circuit is configured to acquire first data in a case that the detection switch device is opened, the first data including noise data caused by a level jump of the multiplexer of the external compensation circuit; and the external compensation circuit is further configured to acquire second data in a case that the detection switch device is closed, the second data including the noise data and electrical data of the pixel unit;

wherein the external compensation circuit is further configured to obtain the electrical data according to the first data and the second data.

In some embodiment of the present disclosure, each pixel unit of the plurality of pixel units further includes a driving switch device, a reset switch device, and an OLED device;

a first end of the driving switch device is connected to a first power line, a second end of the driving switch device is connected to a first end of the reset switch device, a second end of the reset switch device is connected to an anode of the OLED device, a cathode of the OLED device is grounded; and a first end of the detection switch device is respectively connected to the second end of the driving switch device and the first end of the reset switch device, and a second end of the detection switch device is connected to the multiplexer.

In some embodiment of the present disclosure, the external compensation circuit includes the multiplexer, an operational amplifier, an integrating capacitor, an integrating reset switch, a first switch, a first capacitor, a second switch, and a second capacitor;

an input end of the multiplexer is connected to the second end of the detection switch device of a corresponding pixel unit;

a negative input end of the operational amplifier is connected to an output end of the multiplexer, a positive input end of the operational amplifier is connected to a reference voltage line, and an output end of the operational amplifier is respectively connected to a first end of the first switch and a first end of the second switch;

the integrating capacitor and the integrating reset switch are connected in parallel, and are connected between the negative input end of the operational amplifier and the output end of the operational amplifier;

a first end of the first capacitor is connected to a second end of the first switch, and a second end of the first capacitor is grounded; and a first end of the second capacitor is connected to a second end of the second switch, and a second end of the second capacitor is grounded.

In some embodiments of the present disclosure, the external compensation circuit further includes an analog-to-digital converter (ADC), a first end of the ADC is connected to the first end of the first capacitor, and a second end of the ADC is connected to the first end of the second capacitor, and an output end of the ADC is configured to output the electrical data.

In some embodiments of the present disclosure, the external compensation circuit further includes a matching circuit, the matching circuit including an adjustable resistor and a third switch connected in parallel; and a first end of the matching circuit is connected to the output end of the operational amplifier, and a second end of the matching circuit is respectively connected to the first end of the first switch and the first end of the second switch.

At least some of embodiments of the present disclosure provides a method of obtaining electrical data of a pixel unit through an external compensation circuit, the external compensation circuit including a multiplexer, an operational amplifier, an integrating capacitor, an integrating reset switch, a first switch, a first capacitor, a second switch, and a second switch, and a second capacitor, wherein a negative input end of the operational amplifier is connected to an output end of the multiplexer, a positive input end of the operational amplifier is connected to a reference voltage line, an output end of the operational amplifier is respectively connected to a first end of the first switch and a first end of the second switch, the integrating capacitor and the integrating reset switch are connected in parallel and connected between the negative input end of the operational amplifier and the output end of the operational amplifier, a first end of the first capacitor is connected to a second end of the first switch, a second end of the first capacitor is grounded, a first end of the second capacitor is connected to a second end of the second switch, and a second end of the second capacitor is grounded, the method comprises:

acquiring first data in a first detection state, the first data including noise data caused by a level jump of the multiplexer of the external compensation circuit;

acquiring second data in a second detection state, the second data comprising the noise data and the electrical data; and obtaining the electrical data according to the first data and the second data.

In some embodiment of the present disclosure, acquiring the first data in the first detection state includes:

disconnecting the external compensation circuit from the pixel unit;

in a first reset stage, closing the integrating reset switch to reset the integrating capacitor; and in a first integrating stage, opening the integrating reset switch to integrate the integrating capacitor, and closing the first switch to sense the first data by the first capacitor.

In some embodiment of the present disclosure, acquiring the second data in the second detection state includes:

connecting the external compensation circuit to the pixel unit;

in a second reset stage, closing the integrating reset switch to reset the integrating capacitor; and in a second integrating stage, opening the integrating reset switch to integrate the integrating capacitor, and closing the second switch to sense the second data by the second capacitor, wherein the second data is linearly related to a current in the driving switch device of the pixel unit.

At least some embodiments of the present disclosure provide a display panel including the array substrate as described above.

At least some embodiments of the present disclosure provide an electronic apparatus, including:

the display panel as described above;

a processor;

memory, configured to store computer instructions executable by the processor;

wherein, in response to that the processor executing the computer instruction, following operations are implemented:

acquiring first data in a first detection state, the first data including noise data caused by a level jump of the multiplexer of the external compensation circuit;

acquiring second data in a second detection state, the second data including the noise data and the electrical data; and obtaining the electrical data according to the first data and the second data.

In some embodiment of the present disclosure, acquiring the first data in the first detection state includes:

disconnecting the external compensation circuit from the pixel unit;

in a first reset stage, closing the integrating reset switch to reset the integrating capacitor; and in a first integrating stage, opening the integrating reset switch to integrate the integrating capacitor, and closing the first switch to sense the first data by the first capacitor.

In some embodiment of the present disclosure, acquiring the second data in the second detection state includes:

connecting the external compensation circuit to the pixel unit;

in a second reset stage, closing the integrating reset switch to reset the integrating capacitor; and in a second integrating stage, opening the integrating reset switch to integrate the integrating capacitor, and closing the second switch to sense the second data by the second capacitor, wherein the second data is linearly related to a current in the driving switch device of the pixel unit.

It should be noted that the above general description and the following detailed description are only exemplary and explanatory, and cannot be construed as a limit to the present disclosure.

BRIEF DESCRIPTION OF THE DRAWINGS

The drawings herein incorporated into the specification and constituting a part of the specification, illustrate embodiments consistent with the present disclosure, and are used along with the specification to explain the principle of the disclosure.

DETAILED DESCRIPTION OF THE EMBODIMENTS

Here, exemplary embodiments will be described in detail, and examples thereof are illustrated in the accompanying drawings. When the following description refers to the drawings, unless otherwise indicated, the same reference signs in different drawings indicate the same or similar elements. Implementations described in embodiments below do not represent all the embodiments consistent with the present disclosure. On the contrary, they are merely examples of devices and methods consistent with some aspects of the present disclosure as set forth in the appended claims.

Figure 1:
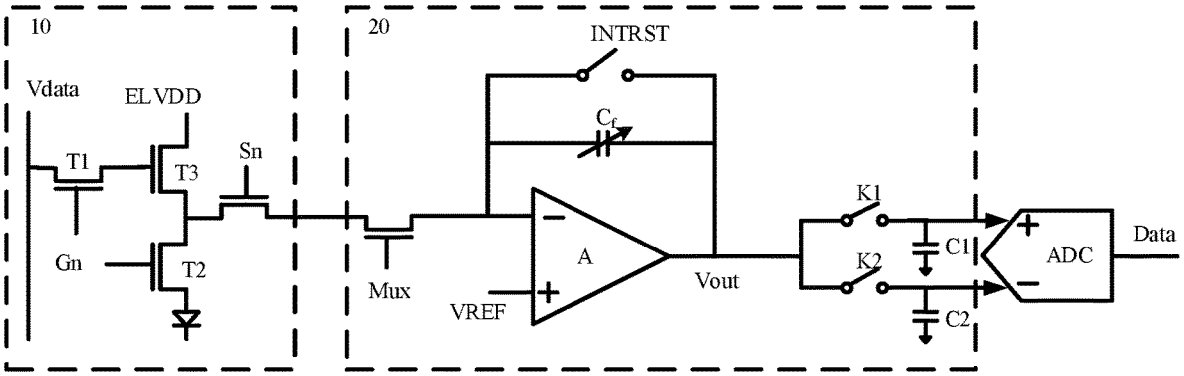
FIG. 1 illustrates a schematic circuit diagram of an array substrate according to an exemplary embodiment of the present disclosure.

At least some embodiments of the present disclosure provide an array substrate, referring to FIG. 1, the array substrate includes a plurality of pixel units 10 and an external compensation circuit 20. Each pixel unit of the plurality of pixel units includes a detection switch device Sn, and the pixel unit is connected to the external compensation circuit 20 through the detection switch device Sn. In the structure as illustrated in FIG. 1, the description is given by taking each switch device being an N-type semiconductor device, that is, a semiconductor device that is turned on (i.e., closed) at a high level and turned off (i.e., opened) at a low level, as an example.

For each pixel unit, the detection switch device Sn is connected to a corresponding input end of the multiplexer Mux of the external compensation circuit. In a case that the detection switch device Sn is turned off, the external compensation circuit 20 is disconnected from the pixel unit and is configured to acquire first data, the first data including noise data caused by a level jump of the multiplexer Mux of the external compensation circuit.

In a case that the detection switch device Sn is turned on, the external compensation circuit 20 is electrically connected to the pixel unit, and is configured to acquire second data. The second data includes the noise data and electrical data of the pixel unit 10.

The external compensation circuit 20 is further configured to acquire the electrical data based on the first data and the second data.

In an embodiment of the present disclosure, continuing to refer to FIG. 1, the pixel unit further includes a driving switch device T3, a reset switch device T2, and an OLED device.

A first end of the driving switch device T3 is connected to a first power line ELVDD, a second end of the driving switch device T3 is connected to a first end of the reset switch device T2; a second end of the reset switch device T2 is connected to an anode of the OLED device; a cathode of the OLED device is grounded.

A first end of the detection switch device Sn is respectively connected to the second end of the driving switch device T3 and the first end of the reset switch device T2, and a second end of the detection switch device Sn is connected to the multiplexer Mux of the external compensation circuit.

It should be noted that Gn indicates a gate control signal of the (n+1)-th row.

In an embodiment of the present disclosure, continuing to refer to FIG. 1, the external compensation circuit 20 includes the multiplexer Mux, an operational amplifier A, an integrating capacitor $C_f$, an integrating reset switch INTRST, a first switch K1, a first capacitor C1, a second Switch K2, and a second capacitor C2.

A negative input end (indicated by "−") of the operational amplifier A is connected to an output end of the multiplexer Mux, and a positive input end of the operational amplifier unit A (indicated by "+") is connected to a reference voltage line $V_{REF}$. An output end of the operational amplifier A (the output voltage being Vout) is respectively connected to a first end of the first switch K1 and a first end of the second switch K2.

The integrating capacitor $C_f$ and the integrating reset switch INTRST are connected in parallel and connected between the negative input end and the output end of the operational amplifier A.

A first end of the first capacitor C1 is connected to a second end of the first switch K1, and a second end of the first capacitor C1 is grounded.

A first end of the second capacitor C2 is connected to the second end of the second switch K2, and the second end of the second capacitor C2 is grounded.

The array substrate further includes an analog-to-digital converter (ADC). A first end of the ADC is connected to the first end of the first capacitor C1, and a second end of the ADC is connected to the first end of the second capacitor C2, and an output end of the ADC is configured to output electrical data.

Figure 2:
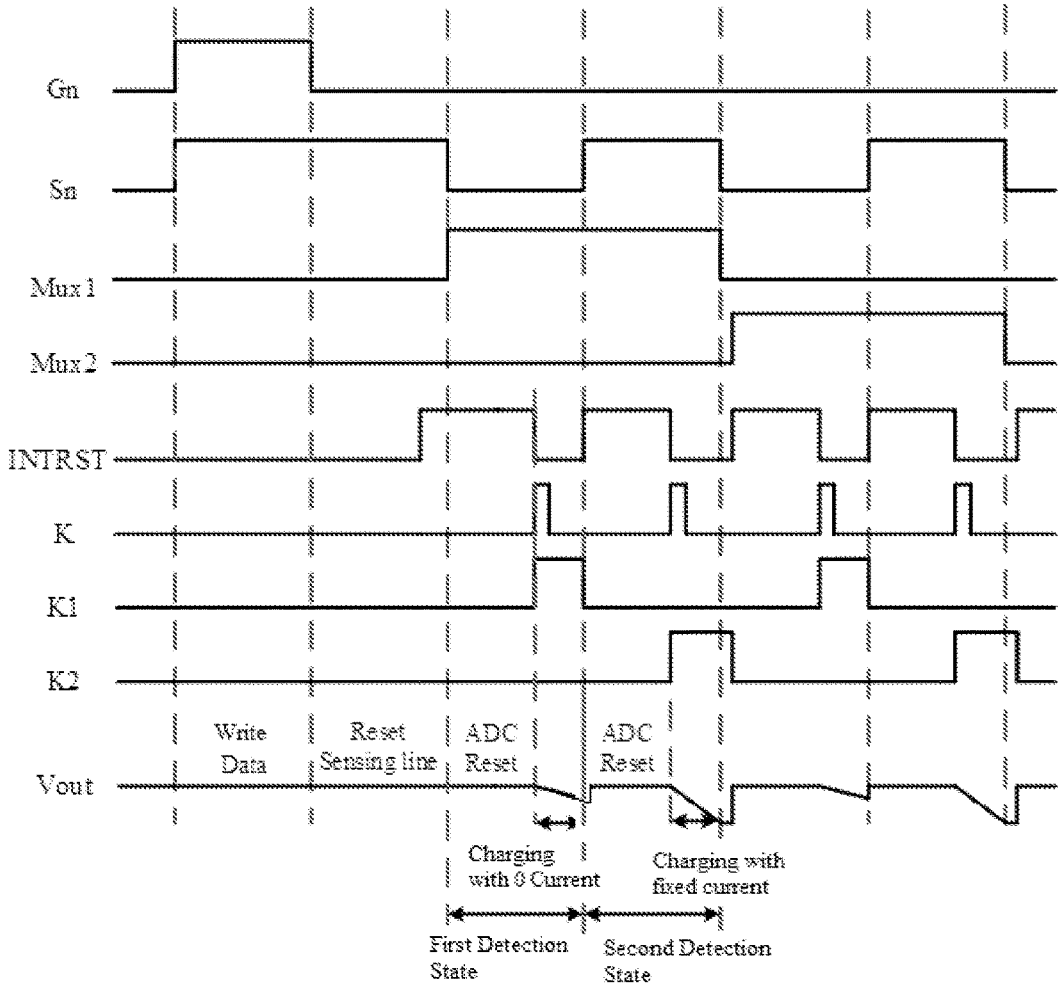
FIG. 2 illustrates a timing chart of the array substrate as illustrated in FIG. 1.

FIG. 2 illustrates a timing chart of the array substrate as illustrated in FIG. 1. Referring to FIGS. 1 and 2, operation process of the array substrate is as follows:

In a time period in which Gn is at a high level, that is, in a time period in which T1 and T2 are turned on, the external compensation circuit controls the multiplexer Mux to switch to the pixel unit n, and detects electrical data of the pixel unit n.

A process of detecting the electrical data of the pixel unit n by the external compensation circuit includes a first detection state and a second detection state.

Figure 3A:
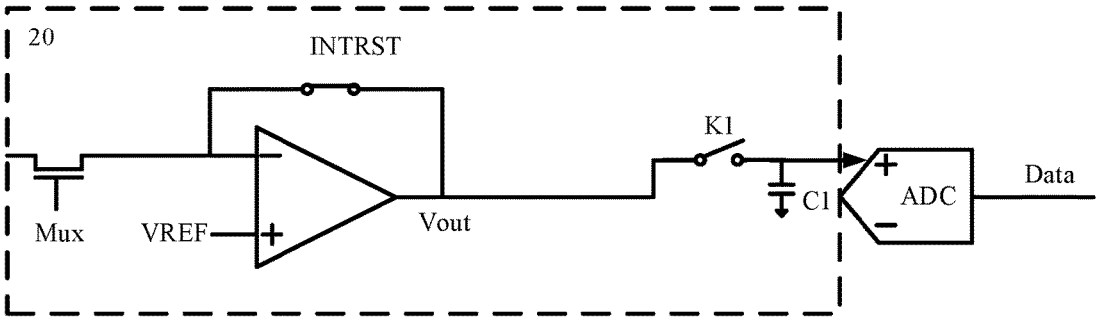
FIG. 3A illustrates an equivalent circuit diagram for a first reset stage.
Figure 3B:
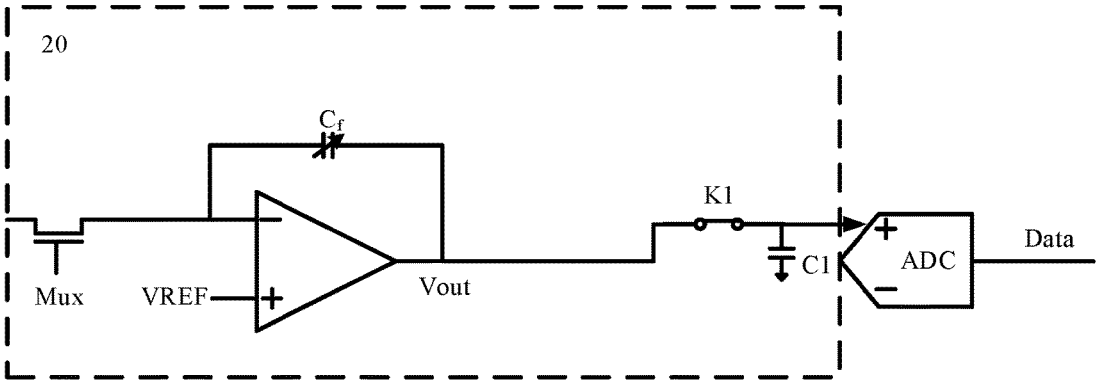
FIG. 3B illustrates an equivalent circuit diagram for a first integrating stage.

In the first detection state, first data including noise data caused by the level jump of the multiplexer Mux is acquired, and the first detection state includes a first reset stage and a first integrating stage:

In the first reset stage, the integrating reset switch INTRST is controlled to close and the detection switch device Sn is controlled to open, the first switch K1 is opened, and the second switch K2 is opened, so as to reset the integrating capacitor. At this time, the operational amplifier is working in a voltage following state, $V_{out}=V_{REF}$, an equivalent circuit is illustrated in FIG. 3A;

In the first integrating stage, the integrating reset switch INTRST is controlled to open and the detection switch device Sn is controlled to open, and the first switch K1 is controlled to be close, and the second switch K2 is controlled to open. An equivalent circuit is illustrated in FIG. 3B. At this time, noise on the sensing line coupled by the coupling capacitor on the sensing line will be integrated by the integrating capacitor $C_f$, so that an output voltage of the operational amplifier $V_{out}=V_{REF}-Vn$ is stored on the first capacitor C1, where $V_{REF}$ indicates the reference voltage, Vn indicates noise data caused by the level jump of the multiplexer Mux.

In the second detection state, second data including the noise data and the electrical data are acquired, and the second detection state includes a second reset stage and a second integrating stage.

Figure 4A:
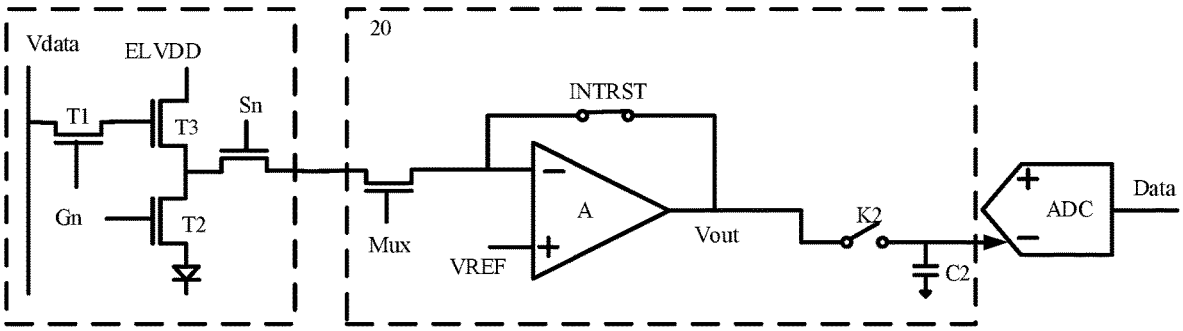
FIG. 4A illustrates an equivalent circuit diagram for a second reset stage.

In the second reset stage, the integrating reset switch INTRST and the detection switch device Sn are controlled to close, the first switch K1 and the second switch K2 are controlled to open, so as to reset the integrating capacitor $C_f$. An equivalent circuit is illustrated in FIG. 4A. At this time, the operational amplifier is operated in a voltage following state, and its output voltage is $V_{out}=V_{REF}$.

Figure 4B:
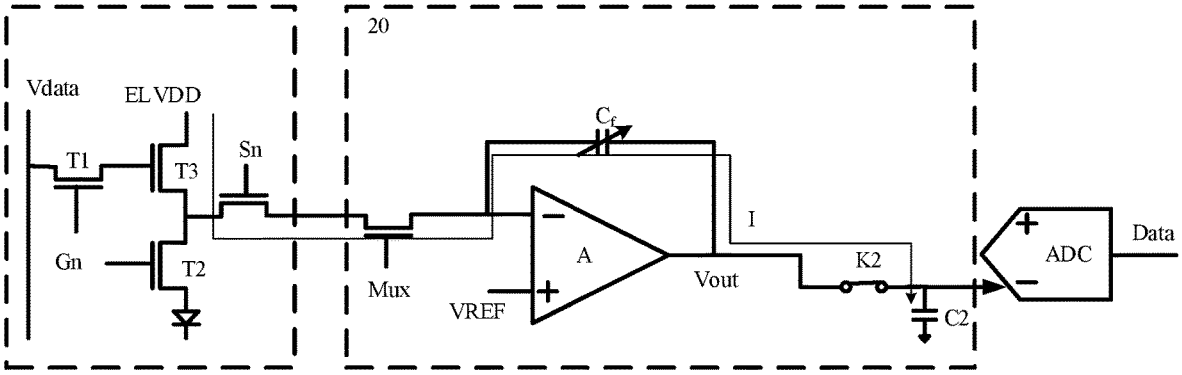
FIG. 4B illustrates an equivalent circuit diagram for a second integrating stage.

In the second integrating stage, the integrating reset switch INTRST is controlled to open, the detection switch device Sn and the second switch K2 are controlled to close, and the first switch K1 is controlled to open, an equivalent circuit is illustrated in FIG. 4B. At this time, a capacitor of the pixel unit stores data Data. And at this time, the driving switch device T3 is turned on, and a current I of the OLED device flows through the integrating capacitor $C_f$, that is, charging the integrating capacitor $C_f$. At this time, the output voltage of the operational amplifier is:

$$Vout=V_{REF}-Vn-\Delta V;$$

where, $V_{REF}$ indicates the reference voltage, Vn represents the noise data caused by the level jump of the multiplexer Mux, ΔV indicates a change in Vout caused by the current I of the OLED device, and the second capacitor C2 can acquire the second data by sensing an output voltage of the operational amplifier, and the second data is linearly related to a current in the driving switch device T3 of the pixel unit.

In this way, the ADC of the external compensation circuit can obtain the voltage difference between the first capacitor C1 and the second capacitor C2 $\Delta V_{out}=(V_{REF}-Vn)-(V_{REF}-Vn-\Delta V)=\Delta V$, ΔV indicates the change in $V_{out}$ caused by the current I of the OLED device, in which the noise data caused by the level jump of the multiplexer Mux is eliminated, thus, electrical parameters of the OLED device can be accurately reflected.

Figure 5:
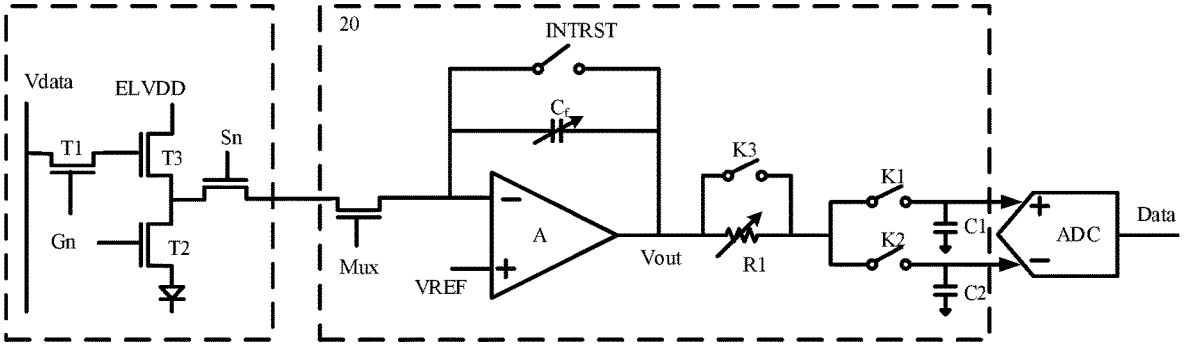
FIG. 5 illustrates a schematic circuit diagram of an array substrate according to another exemplary embodiment of the present disclosure.

In an embodiment of the present disclosure, based on the array substrate as illustrated in FIG. 1 and referring to FIG. 5, the external compensation circuit further includes a matching circuit, and the matching circuit includes an adjustable resistor R1 and a third switch K3 which are connected in parallel.

A first end of the matching circuit is connected to the output end of the operational amplifier A, and a second end of the matching circuit is respectively connected to the first end of the first switch K1 and the first end of the second switch K2.

Figure 6:
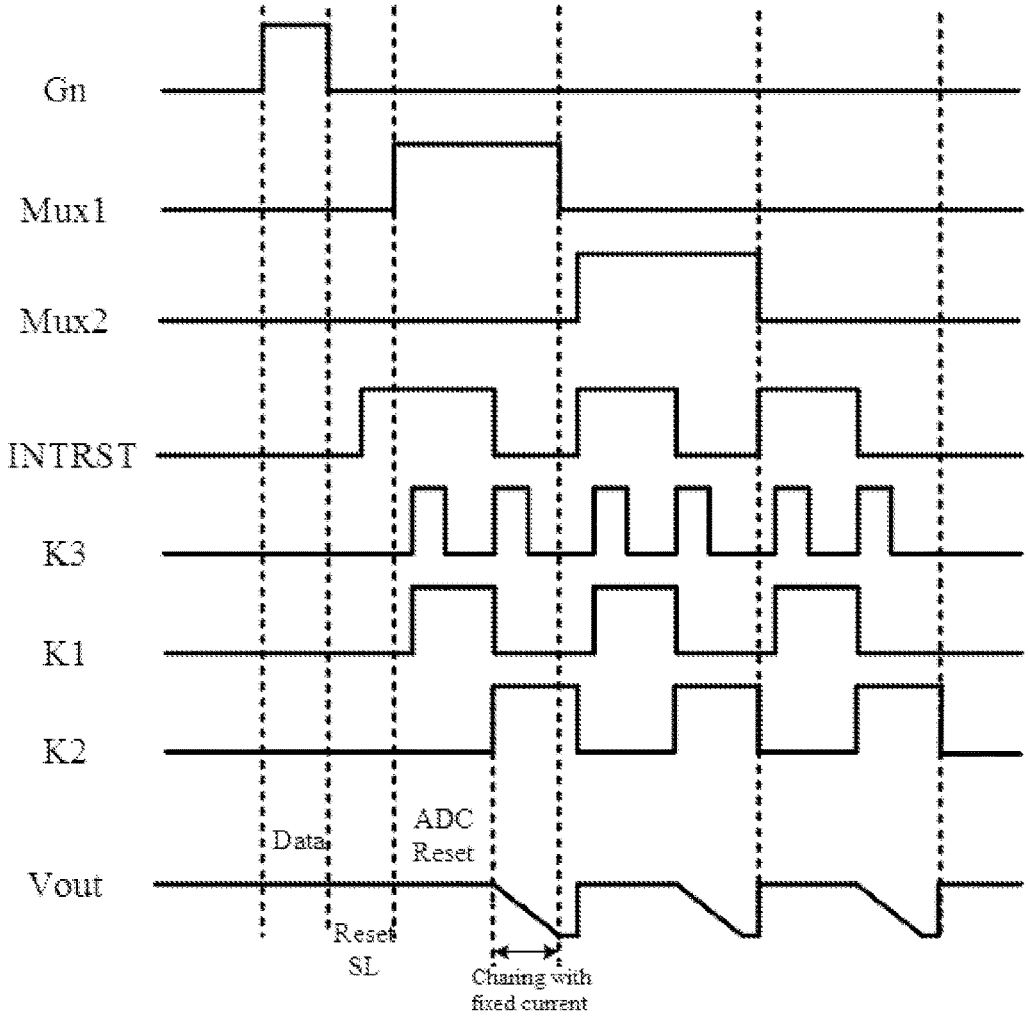
FIG. 6 illustrates a timing chart of the array substrate as illustrated in FIG. 5.

In this embodiment, the adjustable resistor R1, the first capacitor C1 and the second capacitor C2 can form an RC filter, and a filter frequency of the RC filter can be adjusted by adjusting a resistance value of the adjustable resistor R1. Referring to FIG. 6, considering that the RC filter will affect signal transmission, so in the first integrating stage, the third switch K3 and the first switch K1 are closed at the same time, so that the first data can be quickly transmitted to the first capacitor C1; and in the second integrating stage, the third switch K3 and the second switch K2 are closed at the same time, so that the second data can be quickly transmitted to the second capacitor C2. After that, the third switch K3 is turned off after a period of time to restore the filtering function.

As so far, in the embodiments of the present disclosure, by providing the detection switch device in each pixel unit of the array substrate, in a case that the detection switch device is opened, the external compensation circuit may be disconnected from the pixel unit. At this time, the external compensation circuit can obtain the first data including noise data. In a case that the detection switch device is closed, the external compensation circuit can be connected to the pixel unit, and at this time, the external compensation circuit may obtain the second data including the noise data and the electrical data of the pixel unit. In this way, in the embodiment of the present disclosure, by obtaining the difference between the first data and the second data, the noise data caused by the level jump in the first data and the second data can be eliminated, and the electrical data of the pixel unit can be obtained. That is, the embodiments of the present disclosure may eliminate the influence of level jump noise on the electrical data, which is beneficial to improve the accuracy of obtaining the electrical data, and is beneficial to improve the accuracy of compensation data obtained subsequently.

Figure 7:
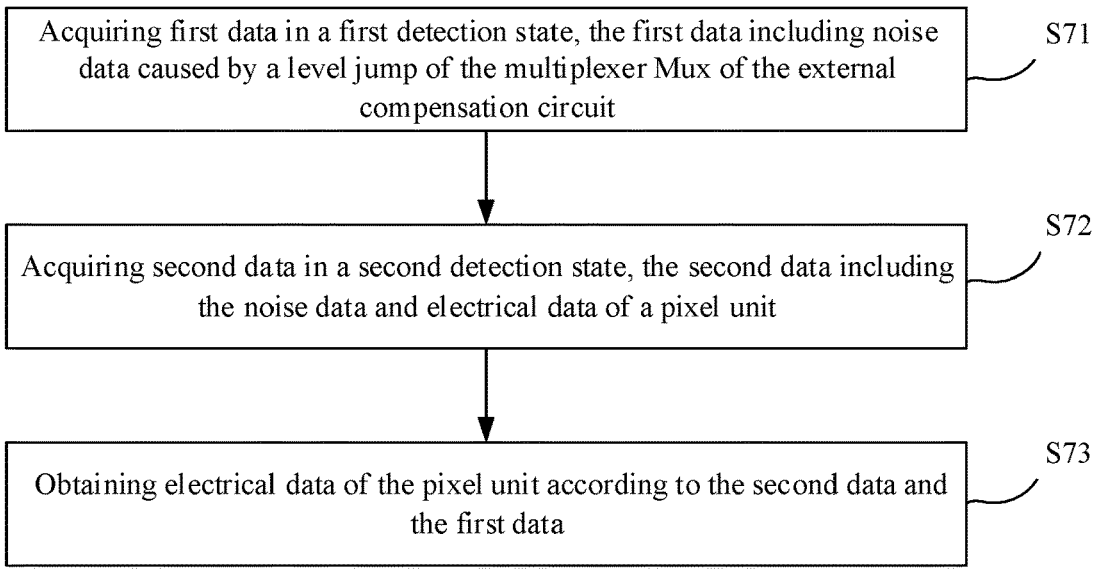
FIG. 7 illustrates a flowchart of a method of obtaining electrical data of a pixel unit according to an exemplary embodiment of the present disclosure.

Based on the array substrate as illustrated in FIG. 1 and the timing chart as illustrated in FIG. 2, an embodiment of the present disclosure further provides a method of obtaining electrical data of a pixel unit through an external compensation circuit. Referring to FIG. 1, the external compensation circuit includes a multiplexer Mux, an operational amplifier A, an integrating capacitor $C_f$, an integrating reset switch INTRST, a first switch K1, a first capacitor C1, a second switch K2, and a second capacitor C2. A negative input end (indicated by "−") is connected to an output end of the multiplexer Mux, a positive input end of the operational amplifier A (indicated by "+") is connected to the reference voltage line $V_{REF}$, and an output end of the operational amplifier A (the output voltage being $V_{out}$) is respectively connected to a first end of the first switch K1 and a first end of the second switch K2, the integrating capacitor $C_f$ and the integrating reset switch INTRST are connected in parallel, and are connected between the negative input end and the output end of the operational amplifier A. Meanwhile, a first end of the first capacitor C1 is connected to the second end of the first switch K1, a second end of the first capacitor C1 is grounded, and a first end of the second capacitor C2 is connected to a second end of the second switch K2, and a second end of the second capacitor C2 is grounded. Referring to FIG. 7, the method includes:

In step S71, first data is acquired in a first detection state, wherein the first data includes noise data caused by a level jump of the multiplexer Mux of the external compensation circuit;

In step S72, second data is acquired in a second detection state, wherein the second data includes the noise data and electrical data of a pixel unit; and In step S73, electrical data of the pixel unit is obtained according to the second data and the first data.

In an embodiment of the present disclosure, step S71 includes:

in a first reset stage, disconnecting the external compensation circuit from the pixel unit, and closing the integrating reset switch INTRST to reset the integrating capacitor $C_f$; and in a first integrating stage, opening the integrating reset switch INTRST to integrate the integrating capacitor, and closing the first switch, and sensing the first data by the first capacitor.

In an embodiment of the present disclosure, step S72 includes:

in a second reset stage, closing the integrating reset switch INTRST to reset the integrating capacitor $C_f$;

in a second integrating phase, connecting the external compensation circuit to the pixel unit, opening the integrating reset switch INTRST, and closing the second switch, so that the second capacitor senses the second data, wherein the second data is linearly related to a current in a driving switch device of the pixel unit.

At least one embodiment of the present disclosure further provides a display panel including the array substrate as illustrated in FIG. 1.

At least one embodiment of the present disclosure further provide an electronic apparatus, including:

the display panel as described above;

a processor; and memory configured to store a computer program executable by the processor;

wherein, in response to the processor executing the computer program stored in the memory, operations of the method of obtaining electrical data of the pixel unit according to the embodiment of the present disclosure as described above are implemented.

One of ordinary skill in the art will easily conceive of other embodiments of the present disclosure after considering the specification and practicing the disclosure disclosed herein. The present disclosure is intended to cover any variations, applications, or modifications that follow the general principles of the present disclosure and include common knowledge or conventional technical means of the art that are not disclosed in the present disclosure. The description and the embodiments are to be regarded as exemplary only, and the true scope and spirit of the present disclosure are defined by the appended claims.

The invention claimed is:

1. An array substrate comprising a plurality of pixel units and an external compensation circuit; wherein for each pixel unit of the plurality of pixel units, the pixel unit comprises a detection switch device, and the pixel unit is connected to a corresponding input end of a multiplexer of the external compensation circuit through the detection switch device;

the external compensation circuit is configured to acquire first data in a case that the detection switch device is opened, the first data comprising noise data caused by a level jump of the multiplexer of the external compensation circuit; and the external compensation circuit is further configured to acquire second data in a case that the detection switch device is closed, the second data comprising the noise data and electrical data of the pixel unit;

wherein the external compensation circuit is further configured to obtain the electrical data according to the first data and the second data;

wherein the level jump of the multiplexer comprises transient state of the multiplexer from high level to low level or from low level to high level;

wherein the external compensation circuit comprises the multiplexer, an operational amplifier, an integrating capacitor, an integrating reset switch, a first switch, a first capacitor, a second switch, and a second capacitor;

an input end of the multiplexer is connected to a first end of the detection switch device of the corresponding pixel unit;

a negative input end of the operational amplifier is connected to an output end of the multiplexer, a positive input end of the operational amplifier is connected to a reference voltage line, and an output end of the operational amplifier is respectively connected to a first end of the first switch and a first end of the second switch;

the integrating capacitor and the integrating reset switch are connected in parallel, and are connected between the negative input end of the operational amplifier and the output end of the operational amplifier;

a first end of the first capacitor is connected to a second end of the first switch, and a second end of the first capacitor is grounded; and a first end of the second capacitor is connected to a second end of the second switch, and a second end of the second capacitor is grounded;

wherein the external compensation circuit further comprises a matching circuit, the matching circuit comprising an adjustable resistor and a third switch connected in parallel; and a first end of the matching circuit is connected to the output end of the operational amplifier, and a second end of the matching circuit is respectively connected to the first end of the first switch and the first end of the second switch.

2. The array substrate according to claim 1, wherein each pixel unit of the plurality of pixel units further comprises a driving switch device, a reset switch device, and an OLED device;

a first end of the driving switch device is connected to a first power line, a second end of the driving switch device is connected to a first end of the reset switch device, a second end of the reset switch device is connected to an anode of the OLED device, a cathode of the OLED device is grounded; and a second end of the detection switch device is respectively connected to the second end of the driving switch device and the first end of the reset switch device.

3. The array substrate according to claim 1, wherein the external compensation circuit further comprises an analog-to-digital converter (ADC), a first end of the ADC is connected to the first end of the first capacitor, and a second end of the ADC is connected to the first end of the second capacitor, and an output end of the ADC is configured to output the electrical data.

4. A display panel, comprising the array substrate according to claim 1.

5. An electronic apparatus, comprising:

the display panel according to claim 4;

a processor;

memory, configured to store computer instructions executable by the processor;

wherein, in response to that the processor executing the computer instructions, following operations are implemented:

acquiring first data in a first detection state, the first data comprising noise data caused by a level jump of the multiplexer of the external compensation circuit;

acquiring second data in a second detection state, the second data comprising the noise data and the electrical data; and obtaining the electrical data according to the first data and the second data;

wherein the level jump of the multiplexer comprises transient state of the multiplexer from high level to low level or from low level to high level;

wherein acquiring the first data in the first detection state comprises:

disconnecting the external compensation circuit from the pixel unit;

in a first reset stage, closing the integrating reset switch to reset the integrating capacitor; and in a first integrating stage, opening the integrating reset switch to integrate the integrating capacitor, and closing the first switch to sense the first data by the first capacitor.

6. The electronic apparatus according to claim 5, wherein acquiring the second data in the second detection state comprises:

connecting the external compensation circuit to the pixel unit;

in a second reset stage, closing the integrating reset switch to reset the integrating capacitor; and in a second integrating stage, opening the integrating reset switch to integrate the integrating capacitor, and closing the second switch to sense the second data by the second capacitor, wherein the second data is linearly related to a current in the driving switch device of the pixel unit.

7. A method of obtaining electrical data of a pixel unit through an external compensation circuit, the external compensation circuit comprising a multiplexer, an operational amplifier, an integrating capacitor, an integrating reset switch, a first switch, a first capacitor, a second switch, and a second capacitor, wherein a negative input end of the operational amplifier is connected to an output end of the multiplexer, a positive input end of the operational amplifier is connected to a reference voltage line, an output end of the operational amplifier is respectively connected to a first end of the first switch and a first end of the second switch, the integrating capacitor and the integrating reset switch are connected in parallel and connected between the negative input end of the operational amplifier and the output end of the operational amplifier, a first end of the first capacitor is connected to a second end of the first switch, a second end of the first capacitor is grounded, a first end of the second capacitor is connected to a second end of the second switch, and a second end of the second capacitor is grounded, the method comprises:

acquiring first data in a first detection state, the first data comprising noise data caused by a level jump of the multiplexer of the external compensation circuit;

acquiring second data in a second detection state, the second data comprising the noise data and the electrical data; and obtaining the electrical data according to the first data and the second data;

wherein the level jump of the multiplexer comprises transient state of the multiplexer from high level to low level or from low level to high level;

wherein acquiring the first data in the first detection state comprises:

disconnecting the external compensation circuit from the pixel unit;

in a first reset stage, closing the integrating reset switch to reset the integrating capacitor; and in a first integrating stage, opening the integrating reset switch to integrate the integrating capacitor, and closing the first switch to sense the first data by the first capacitor.

8. The method according to claim 7, wherein acquiring the second data in the second detection state comprises:

connecting the external compensation circuit to the pixel unit;

in a second reset stage, closing the integrating reset switch to reset the integrating capacitor; and in a second integrating stage, opening the integrating reset switch to integrate the integrating capacitor, and closing the second switch to sense the second data by the second capacitor, wherein the second data is linearly related to a current in the driving switch device of the pixel unit.

* * * * *